US008233814B2

(12) United States Patent
Sheen

(10) Patent No.: US 8,233,814 B2
(45) Date of Patent: Jul. 31, 2012

(54) DEVELOPER SUPPLYING APPARATUS AND IMAGE FORMING APPARATUS HAVING THE SAME

(75) Inventor: So-Won Sheen, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 421 days.

(21) Appl. No.: 12/542,337

(22) Filed: Aug. 17, 2009

(65) Prior Publication Data

US 2010/0158573 A1 Jun. 24, 2010

(30) Foreign Application Priority Data

Dec. 18, 2008 (KR) ..... 10-2008-0129654

(51) Int. Cl.
*G03G 15/10* (2006.01)
*G03G 15/08* (2006.01)

(52) U.S. Cl. ..... 399/58; 399/30; 399/254; 399/258

(58) Field of Classification Search ..... 399/24, 399/30, 58, 59, 61, 62, 254–256, 258–260, 399/262, 263

See application file for complete search history.

(56) References Cited

U.S. PATENT DOCUMENTS 7,092,647 B2 * 8/2006 Suzuki ..... 399/27

FOREIGN PATENT DOCUMENTS

JP 2002014527 A * 1/2002
JP 2002328530 A * 11/2002

* cited by examiner

*Primary Examiner* — David Gray
*Assistant Examiner* — Joseph S Wong
(74) *Attorney, Agent, or Firm* — Staas & Halsey LLP

(57) ABSTRACT

A developer supplying apparatus can include a first chamber and a second chamber defined within a housing. Each of the first and second chambers may include an agitator disposed therein. A magnetic body may be disposed near the first chamber to receive toner from the first chamber. A controller can determine the level of developer received in the first chamber, and to based on the determined developer level control the operations of one or more of the agitators and the magnetic body in order to ensure sufficient supply of the developer in the first chamber to reduce the occurrences of image defects, such as, for example, auger marks.

19 Claims, 7 Drawing Sheets

DEVELOPER SUPPLYING APPARATUS AND IMAGE FORMING APPARATUS HAVING THE SAME

CROSS-REFERENCE TO RELATED APPLICATIONS

This application claims the benefit under 35 U.S.C. §119 (a) from Korean Patent Application No. 2008-129654 filed Dec. 18, 2008 in the Korean Intellectual Property Office, the disclosure of which is incorporated herein by reference in its entirety.

1. Technical Field

The present disclosure generally relates to an image forming apparatus. More particularly, the present disclosure relates to a developer supplying apparatus for an image forming apparatus using two-component developer.

2. Background of Related Art

Generally speaking, an electro-photographic image forming apparatus can include a photosensitive medium on which electrostatic latent images corresponding to print data are formed and a developing apparatus that supplies developer to the photosensitive medium to develop the electrostatic latent images into a visible image.

The developing apparatus can include a developing roller that supplies developer to the photosensitive medium and a developer-storing chamber in which the developer supplied by the developing roller can be stored. When a two-component developer is used to form the images, a magnetic roller can be used as the developing roller. The magnetic roller can be configured to convey developer using a magnetic force.

Moreover, the developing apparatus using the two-component developer can include two developer-storing chambers. Two developer agitating members can be disposed in the two developer-storing chambers so that the two-component developer can be agitated and circulate inside the developing apparatus.

SUMMARY OF THE DISCLOSURE

According to one aspect of the present disclosure, a developer supplying apparatus for use with an image forming apparatus may be provided to include a housing defining a first chamber and a second chamber, a magnetic medium of magnetic material rotatably disposed near the first chamber of the housing, a first agitating member, a second agitating member and a controller. The first agitating member may be disposed in the first chamber of the housing so as to agitate the developer in the first chamber and to move the developer in the first chamber in a first direction. The second agitating member may be disposed in the second chamber of the housing so as to agitate the developer in the second chamber and to move the developer in the second chamber in a second direction different from the first direction. The controller may be configured to increase a first developer level associated with an amount of developer in the first chamber when the first developer level is below a predetermined level in such a manner that the first developer level is different from a second developer level associated with an amount of developer in the second chamber.

The developer supplying apparatus may further comprise a conveyor disposed between the first chamber and the second chamber of the housing, the conveyer being configured to move developer from the second chamber to the first chamber. The controller may be configured to control the conveyor to adjust the first developer level in the first chamber and the second developer level in the second chamber.

The conveyor may be configured to produce a magnetic force to move developer from the second chamber to the first chamber.

The conveyor may comprise one of an auger and a paddle.

The controller may be configured to adjust a rotational speed associated with the conveyor to control an amount of developer moved by the conveyor from the second chamber to the first chamber.

The developer supplying apparatus may further comprise a sensor disposed in the first chamber and configured to detect the amount of developer in the first chamber. The controller may be configured to use information provided by the sensor to determine whether the first developer level is lower than the predetermined level.

The developer supplying apparatus may further comprise a sensor disposed in the second chamber and configured to detect a developer concentration. The controller may be configured to use information provided by the sensor to determine whether the first developer level is lower than the predetermined level.

The controller may be configured to determine whether the first developer level is lower than the predetermined level based on a developer concentration of an image formed by the image forming apparatus.

The controller may be configured to determine whether the first level is lower than the predetermined level based on a remaining useful life of the developer supplying apparatus.

The first chamber and the second chamber may be vertically arranged. Alternatively, the first chamber and the second chamber are horizontally arranged.

The second chamber may be configured to receive developer from the magnetic medium.

According to another aspect, an image forming apparatus may be provided to include a photosensitive medium, a developer supplier, a transfer roller and a controller. The developer supplier may be configured to supply developer to the photosensitive medium to form toner images. The developer supplier may include a housing that defines a first and a second chamber, a magnetic medium that includes magnetic material rotatably disposed near the first chamber of the housing, a first agitating member disposed in the first chamber of the housing and a second agitating member disposed in the second chamber of the housing. The first agitating member may be configured to agitate developer in the first chamber and to move the developer in the first chamber in a first direction. The second agitating member may be configured to agitate the developer in the second chamber and to move developer in the second chamber in a second direction different from the first direction. The transfer roller may be configured to transfer the toner images formed on the photosensitive medium to a printing medium. The controller may be configured to increase a first developer level associated with an amount of developer in the first chamber when the first developer level is below a predetermined level in such a manner that the first developer level is different from a second developer level associated with an amount of developer in the second chamber.

According to yet another aspect, a developer supplying apparatus for supplying developer of a two-component type containing a mixture of toner and carrier may be provided to include a first chamber, a second chamber, a magnetic member and a controller. The first and second chambers may each define a volume in which to receive the developer, and may be in fluid communication so as to allow an amount of the developer to move from the second chamber to the first chamber. The magnetic member may include a magnetic material, and may be disposed near the first chamber to receive toner particles of the developer from the first chamber. The second chamber may be configured to receive carrier particles of the developer from the magnetic member, and to receive supplemental supply of the developer. The controller may be configured to adjust the amount of the developer moving from the second chamber to the first chamber based on a level of developer received in the first chamber.

The developer supplying apparatus may further comprise a developer conveying device disposed between the first and second chambers and configured to transfer the developer from the second chamber to the first chamber. The controller may be further configured to control the developer conveying device so as to adjust the amount of developer moving from the second chamber to the first chamber.

The developer supplying apparatus may further comprise a first agitator disposed in the first chamber and configured to move the developer received in the first chamber and a second agitator disposed in the second chamber and configured to move the developer received in the second chamber. The controller may be configured to control respective rotational speeds of the first and second agitator so as to increase a net amount of developer moving from the second chamber to the first chamber.

The developer supplying apparatus may further comprise a developer level sensor configured to detect the level of developer received in the first chamber. The controller may be configured to determine whether the level of developer received in the first chamber is less than a threshold level based on a detection signal received from the developer level sensor, and, if the level of developer received in the first chamber is determined to be less than the threshold level, to increase the amount of the developer moving from the second chamber to the first chamber.

Alternatively, the controller may be configured to determine whether the level of developer received in the first chamber is less than a threshold level based on remaining useful life of the developer supplying apparatus, and, if the level of developer received in the first chamber is determined to be less than the threshold level, to increase the amount of the developer moving from the second chamber to the first chamber.

As an another alternative, the controller may be configured to determine whether the level of developer received in the first chamber is less than a threshold level based on cumulative number of toner images formed using the developer supplying apparatus, and, if the level of developer received in the first chamber is determined to be less than the threshold level, to increase the amount of the developer moving from the second chamber to the first chamber.

Each of the first and second agitators may comprise an auger. The first agitator may be configured to move the developer received in the first chamber in a first direction. The second agitator may be configured to move the developer received in the second chamber in a second direction opposite the first direction.

BRIEF DESCRIPTION OF THE DRAWINGS

Various features and advantages of the disclosure will become apparent and more readily appreciated from the following description of the embodiments, taken in conjunction with the accompanying drawings, in which.

Throughout the drawings, like reference numerals can be understood to refer to like parts, components and structures.

DETAILED DESCRIPTION OF SEVERAL EMBODIMENTS

Several embodiments of the present disclosure are described below in detail with reference to the accompanying drawings.

The matters disclosed in the description, such as a detailed construction and elements thereof, are provided to assist in a comprehensive understanding of the embodiments. It should however be apparent that some embodiments of the present disclosure may be carried out without those disclosed detailed construction and elements and that that various changes and modifications can be made thereto. Also, well-known functions or constructions may be omitted to provide a clear and concise description of the embodiments so as not to obscure the same in unnecessary details.

Figure 1:
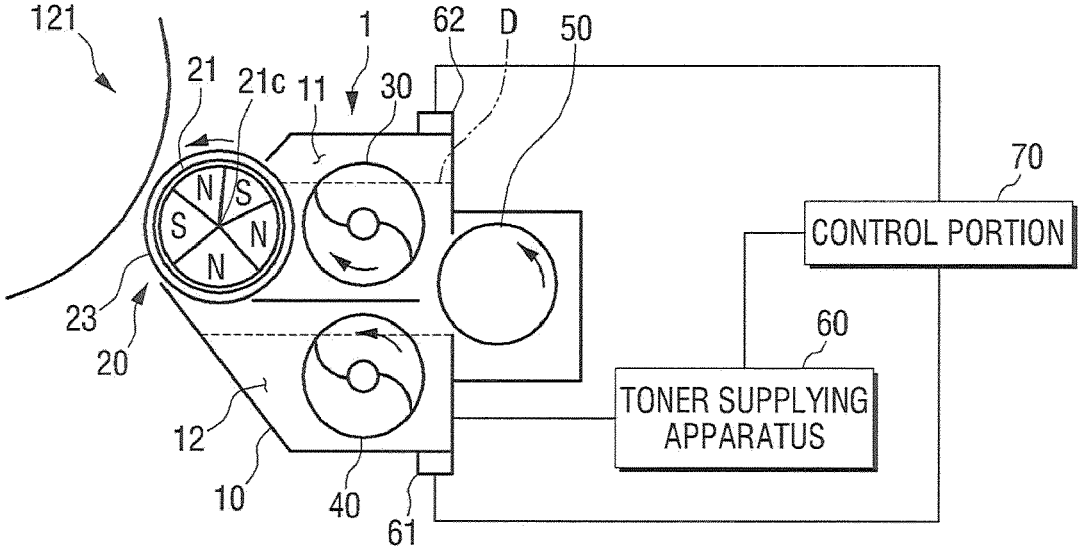
FIG. 1 is a sectional view schematically illustrating a developer supplying apparatus according to an embodiment of the present disclosure usable with an image forming apparatus.
Figure 2:
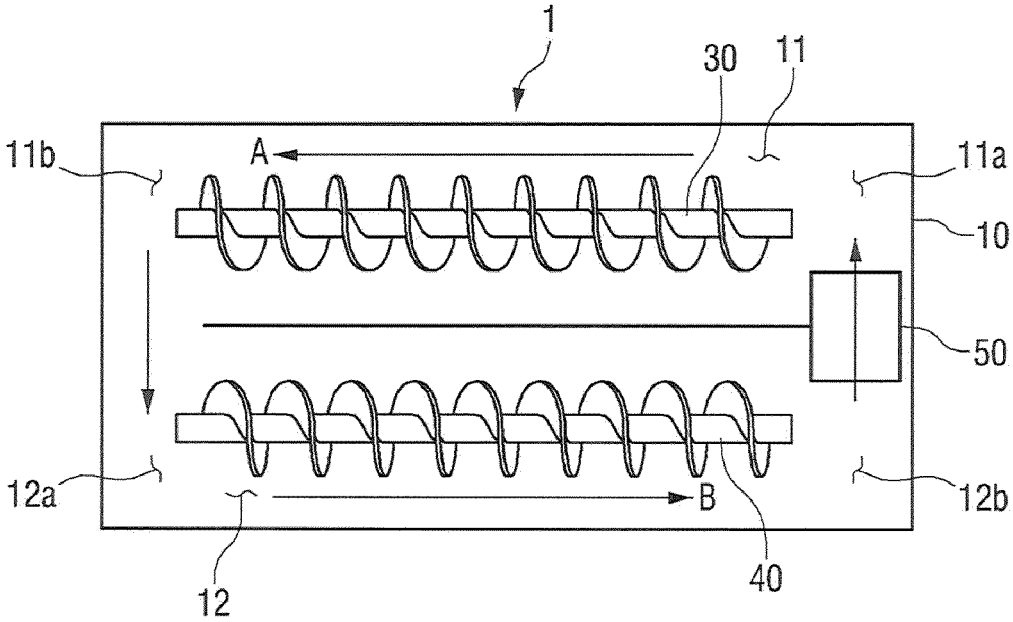
FIG. 2 conceptually illustrates the movement of developer in a developer supplying apparatus according to an embodiment of the present disclosure.

FIG. 1 is a sectional view schematically illustrating a developer supplying apparatus 1 according to an embodiment of the present disclosure that can be used with an image forming apparatus. FIG. 2 is illustrative of the movement of the developer in a developer supplying apparatus 1 according to an embodiment of the present disclosure.

Referring to FIG. 1, the developer supplying apparatus 1 can include a housing 10, a magnetic medium 20, a first developer agitating member 30, a second developer agitating member 40 and a control portion 70.

Figure 6:
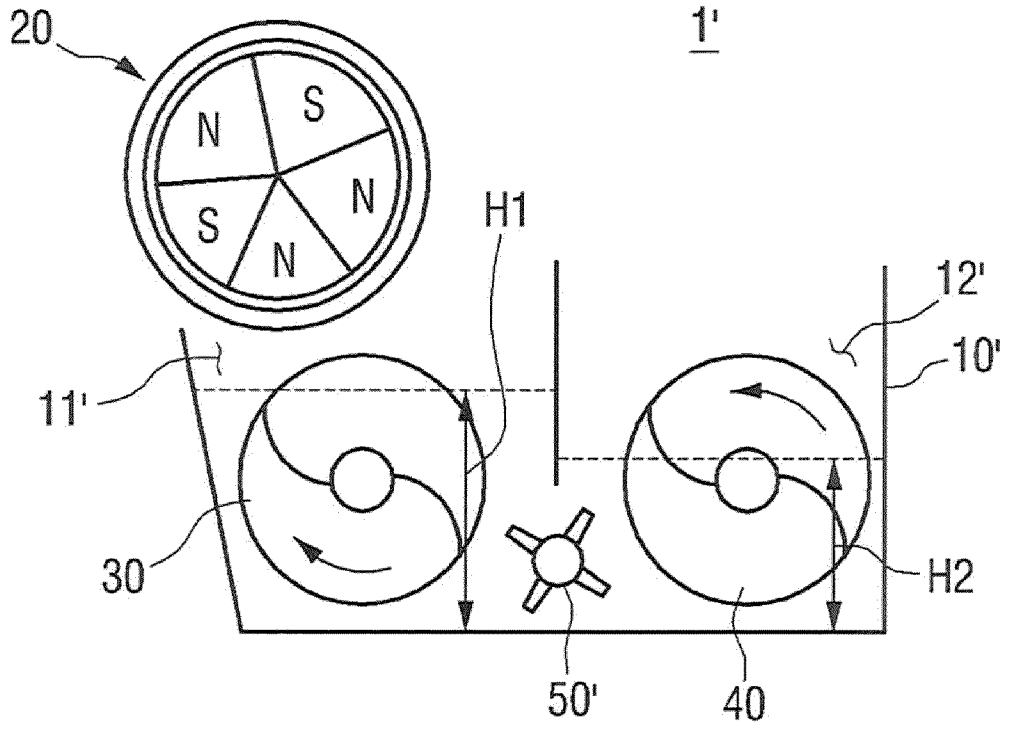
FIG. 6 is a sectional view schematically illustrating a developer supplying apparatus according to another embodiment of the present disclosure.

The housing 10 can be configured to define the outer appearance of the developer supplying apparatus 1. The inner space of the housing 10 can be divided into a first developer chamber 11 and a second developer chamber 12 in each of which developer D can be received. The first and second developer chambers 11 and 12, as illustrated in FIG. 2, can be configured so that an upstream portion 11*a* and a downstream portion 11*b* associated with the first developer chamber 11 can be in fluid communication with each other, and an upstream portion 12*a* and a downstream portion 12*b* associated with the second developer chamber 12 can be in fluid communication with each other. Moreover, the first developer chamber 11 and the second developer chamber 12 can be configured vertically so that the first developer chamber 11 is disposed above the second developer chamber 12. In other words, the first developer chamber 11 can be vertically arranged in parallel with the second developer chamber 12. Such configuration, however, does not limit the arrangements in which the first and second developer chambers 11 and 12 can be configured. For example, as illustrated in FIG. 6, the first developer chamber 11 and the second developer chamber 12 can be horizontally arranged.

The magnetic medium 20 can be rotatably disposed in an opening of the housing 10. The magnetic medium 20 can be disposed near or directly adjacent to the first developer chamber 11 to convey developer D stored in the first developer chamber 11 of the housing 10 to a space outside of the housing 10. In an embodiment of the present disclosure, the magnetic medium 20 can be configured to function as a developing roller that supplies developer to a photosensitive medium 121. When the magnetic medium 20 is configured to function as a developing roller, the developer supplying apparatus 1 can be used as a developing apparatus.

The magnetic medium 20 can include a fixed magnet assembly 21 and a developing sleeve 23 that is disposed around the fixed magnet assembly 21. The magnetic medium 20 can be configured to rotate about a longitudinal center axis 21*c* of the fixed magnet assembly 21. The fixed magnet assembly 21 can be configured to include multiple fixed magnets arranged in a substantially cylindrical shape. The magnetic poles of the fixed magnets can be arranged so that the developing sleeve 23 can convey developer to the photosensitive medium 121. In an embodiment of the present disclosure, five fixed magnets have magnetic poles arranged in order of N, S, N, S, and N in a counterclockwise direction from the fixed magnet facing the first developer agitating member 30.

The developer supplying apparatus 1 can use a two-component developer D that includes toner and carrier. The toner can provide a specific color to images and the carrier can convey the toner to the developing sleeve 23. The carrier of the two component developer D can be made of a material having magnetic properties.

When the developing apparatus, such as the developer supplying apparatus 1 of FIG. 1, for example, uses a two-component developer to develop electrostatic latent images on the photosensitive medium 121, properly controlling the amount of developer on a surface of the magnetic medium 20 can be important. An image concentration can be generally proportional to the amount of developer on the surface of the magnetic medium 20. When there is too much developer on the surface of the magnetic medium 20, for example, a so-called "carrier phenomenon" may occur. A carrier phenomenon refers to having carrier move with the toner when toner moves from the magnetic medium 20 to the photosensitive medium 121 and having the carrier attached on the photosensitive medium 121. Controlling the carrier phenomenon to limit its occurrences below a certain level may be difficult. Therefore, the amount of carrier that is received in the developer supplying apparatus 1 may become slowly depleted during the lifetime of the developer supplying apparatus 1.

On the other hand, the developer supplying apparatus 1 can be generally configured so that toner is supplementarily supplied from a toner supplying apparatus 60 in light of the fact that the toner is consumed when forming the images. However, the supply of the carrier is not similarly supplemented because the carrier is not intended to be consumed when forming the images. The toner supplying apparatus 60 can be configured to measure a toner concentration using a toner concentration sensor 61 disposed in the second developer chamber 12 of the housing 10, and can be configured to supply a proper amount of toner to maintain the toner concentration level. According to an embodiment, the toner concentration can be expressed according to the following expression:

$$\text{Toner concentration} = \text{the amount of toner}/(\text{the amount of carrier} + \text{the amount of toner}) \quad \text{(Equation 1).}$$

When the carrier is not supplemented in the developer supplying apparatus 1, due to the carrier phenomenon, the amount of carrier remaining in the developer supplying apparatus 1 may decrease. When the amount of carrier decreases, the amount of toner supplied from the toner supplying apparatus 60 to the developer supplying apparatus 1 to maintain the toner concentration level can also decrease, resulting in the reduction of the overall amount of developer in the housing 10. When the amount of the developer in the housing 10 is reduced below a certain amount, that is, when a first developer level H1 (see, e.g., FIG. 3) of the first developer chamber 11 is below a certain level, traces associated with the developer agitating member 30 (e.g., an auger or screw conveyor configured to agitate the developer) may appear on a printed image. This image defect is generally referred to as 'auger mark'. For example, the auger mark can occur when the amount of developer in the housing 10 is about 10 percent (%) less than the primary amount of developer in the housing 10. The above value however is provided by way of example only. In other examples, the amount of developer that can result in having an auger mark appear on the printed images can change based on, for example, a type of toner, a type of carrier, the shape of the developer agitating member 30, and/or the structure of the developer supplying apparatus 1.

Developer in the first developer chamber 11 can be moved and attached to the developing sleeve 23 by a magnetic force of the fixed magnet assembly 21. Because of the rotation of the developing sleeve 23, the developer attached to the developing sleeve 23 can be moved to a position facing the photosensitive medium 121. When the developer is moved to a position facing the photosensitive medium 121, the toner in the developer can move to the photosensitive medium 121 to develop an electrostatic latent image formed on the photosensitive medium 121 into a visible image while the carrier in the developer can remain attached to the developing sleeve 23. When the developing sleeve 23 rotates, the carrier and some toner that may remain attached to the developing sleeve 23 can be separated from the developing sleeve 23, and can be collected in the second developer chamber 12.

As shown in FIG. 2, the first developer agitating member 30 can be disposed in the first developer chamber 11 of the housing 10, and can be configured to rotate about a longitudinal axis thereof. The first developer agitating member 30 can be configured to convey or move developer in the first developer chamber 11 in a first direction (shown by arrow A) while agitating the developer in the first developer chamber 11. The first developer agitating member 30 can be made to have a screw or auger shape. Therefore, when the first developer agitating member 30 rotates, the developer is agitated and conveyed in the first direction as illustrated by arrow A in FIG. 2. When the first developer agitating member 30 rotates, the carrier and the toner that form the developer are nixed with each other so that the toner particles attach to the carrier particles. The downstream portion 11*b* of the first developer chamber 11, as illustrated in FIG. 2, can be in fluid communication with the upstream portion 12*a* of the second developer chamber 12 so that the developer conveyed by the first developer agitating member 30 can enter the second developer chamber 12.

The second developer agitating member 40 can be disposed in the second developer chamber 12, and can be configured to rotate about a longitudinal axis thereof. The second developer agitating member 40 can be configured to convey or move developer in the second developer chamber 12 in a second direction (shown by arrow B) while agitating the developer in the second developer chamber 12. The second direction B can be a reverse direction from the first direction A so that the developer can be circulated between the first developer chamber 1 and the second developer chamber 12. The second developer agitating member 40 can be made to have a screw or auger shape. Therefore, when the second developer agitating member 40 rotates, the developer can be agitated and conveyed in the second direction as illustrated by arrow B in FIG. 2. When the second developer agitating member 40 rotates, the carrier withdrawn from the magnetic medium 20 and the carrier and the toner mixture remaining in the second developer chamber 12 can be mixed with each other. When the toner supplying apparatus 60 is connected to the second developer chamber 12, the carrier withdrawn from the magnetic medium 20, the carrier/toner mixture remaining in the second developer chamber 12 and the toner supplied by the toner supplying apparatus 60 can be mixed with each other by the second developer agitating member 40 in the second developer chamber 12. The downstream portion 12*b* of the second developer chamber 12, as illustrated in FIG. 2, can be in fluid communication with the upstream portion 11*a* of the first developer chamber 11 so that the developer conveyed in the second direction by the second developer agitating member 40 can enter the first developer chamber 11.

A developer conveying member 50 can be disposed between the downstream portion 12*b* of the second developer chamber 12 and the upstream portion 11*a* of the first developer chamber 11. The developer conveying member 50 can be configured to connect the upstream portion 11*a* of the first developer chamber 11 and the downstream portion 12*b* of the second developer chamber 12, and to move the developer conveyed to the downstream portion 12*b* of the second developer chamber 12 by the second developer agitating member 40 to the upstream portion 11*a* of the first developer chamber 11. The developer conveying member 50 can be configured to move the developer from the second developer chamber 12 to the first developer chamber 11 using magnetic properties. In some embodiments, the developer conveying member 50 can alternatively be configured to have a similar structure to the structure of the magnetic medium 20 as described above to convey the developer from the second developer chamber 12 to the first developer chamber 11. In other embodiments, the developer conveying member 50 can be configured to mechanically move the developer, and can to that end be made to have an auger, a screw, and/or a paddle shape, for example. The developer conveying member 50 can have any of various configurations and/or shapes that allow the developer conveying member 50 to convey the developer from the second developer chamber 12 to the first developer chamber 11.

The control portion 70 can include hardware (e.g., input/output interfaces, circuitry, central processing units, microcontrollers, memory) and/or software (e.g., operating system, drivers, programs, applications) that can be configured to control the rotation of the first developer agitating member 30, the second developer agitating member 40 and/or the developer conveying member 50. The control portion 70 can be configured to receive a signal form the toner concentration sensor 61, and can be configured to use information associated with that signal to control the toner supplying apparatus 60 to supply toner to the housing 10. Although not illustrated, each of the first developer agitating member 30, the second developer agitating member 40 and the developer conveying member 50 can have a driving portion (e.g., motor) configured to rotate those devices. The control portion 70 can be configured to control the driving portions, thereby controlling the rotational speed, that is, the number of rotation per unit time, of each of the first developer agitating member 30, the second developer agitating member 40 and the developer conveying member 50. In some embodiments, the second developer agitating member 40 and the developer conveying member 50 can be configured to be driven by the same drive portion.

As illustrated in FIGS. 1 and 2, the control portion 70 can be configured to control the first and second developer agitating members 30 and 40 and the developer conveying member 50 so that the developer can be circulated between the first developer chamber 11 and the second developer chamber 12. The carrier collected from the magnetic medium 20 in the second developer chamber 12 can be agitated or mixed with the carrier and the toner remaining in the second developer chamber 12, and can then be moved to the first developer chamber 11. As a result, the carrier can be mixed with toner for use by the developer supplying apparatus 1.

Moreover, when the first developer level H1 associated with an amount of developer in the first developer chamber 11 (see FIG. 3) and a second developer level H2 associated with an amount of developer in the second developer chamber 12 (see FIG. 3) are lower than a predetermined level of developer, namely, a reference level H, the control portion 70 can control portions of the developer supplying apparatus 1 so that the first developer level H1 of the first developer chamber 11 is different from the second developer level H2 of the second developer chamber 12. That is, when the first developer level H1 of the first developer chamber 11 is lower than the reference level H, the control portion 70 can control the first and second developer agitating members 30 and 40 so that the second developer level H2 of the second developer chamber 12 is lowered while the first developer level H1 of the first developer chamber 11 can be raised up to maintain the amount of developer in the first developer chamber 11 at the reference level H. That is, the control portion 70 can control a first rotational speed of the first developer agitating member 30 and a second rotational speed of the second developer agitating member 40 to differ from each other so that the amount of developer moved from the second developer chamber 12 to the first developer chamber 11 becomes larger than the amount of developer moved from the first developer chamber 11 to the second developer chamber 12.

For example, the control portion 70 can control the first developer agitating member 30 to rotate at a normal or nominal rotational speed, and can control the rotational speed of the second developer agitating member 40 such that the second developer agitating member 40 can convey the developer from the second developer chamber 12 to the first developer chamber 11 at a rate that allows for the first developer level H1 of the first developer chamber 11 to be maintained at the reference level H. As a result, the first developer level H1 of the first developer chamber 11 can be raised to the reference level H while the second developer level H2 of the second developer chamber 12 is reduced to a level that is lower than the first developer level H1 of the first developer chamber 11. Thus, the control portion 70 can be configured to control or adjust the first and second developer levels H1 and H2 of the first and second developer chambers 11 and 12 of the developer supplying apparatus 1 to be different from each other.

When the developer supplying apparatus 1 includes the developer conveying member 50, the control portion 70 can control the rotational speed of the developer conveying member 50 to adjust the amount of developer conveyed from the second developer chamber 12 to the first developer chamber 11. As a result, the control portion 70, by adjusting the rotation speed of the developer conveying member 50, can control the first developer level H1 of the first developer chamber 11 to be different from the second developer level H2 of the second developer chamber 12. For example, when the control portion 70 increases the rotation speed of the developer conveying member 50, the amount of developer conveyed from the second developer chamber 12 to the first developer chamber 11 can increase so that the first developer level H1 of the first developer chamber 11 can be raised.

The reference level H can refer to a developer level at which an auger mark image defect is not likely to occur. That is, the reference level H may be a predetermine height of developer associated with an amount of developer in the first developer chamber 11 in the developer supplying apparatus 1 at which the developer supplying apparatus 1 can normally supply the developer with no substantial likelihood of the occurrences of auger mark. In some embodiments, the reference level H may be set as a predetermined range and not a single target value. Therefore, to prevent an auger mark from occurring, when the first developer level H1 of the first developer chamber 11 is below the reference level H, the control portion 70 can be configured to perform appropriate control operations to raise the first developer level H1 of the first developer chamber 11 such that the developer level reaches the reference level H. The control portion 70 can determine whether the first developer level H1 is below the reference level H. The control portion 70 can use various methods, some of which are described below, to determine whether the first developer level H1 is below the reference level H. These determining methods can be stored in a memory of the control portion 70, for example.

Figure 7:
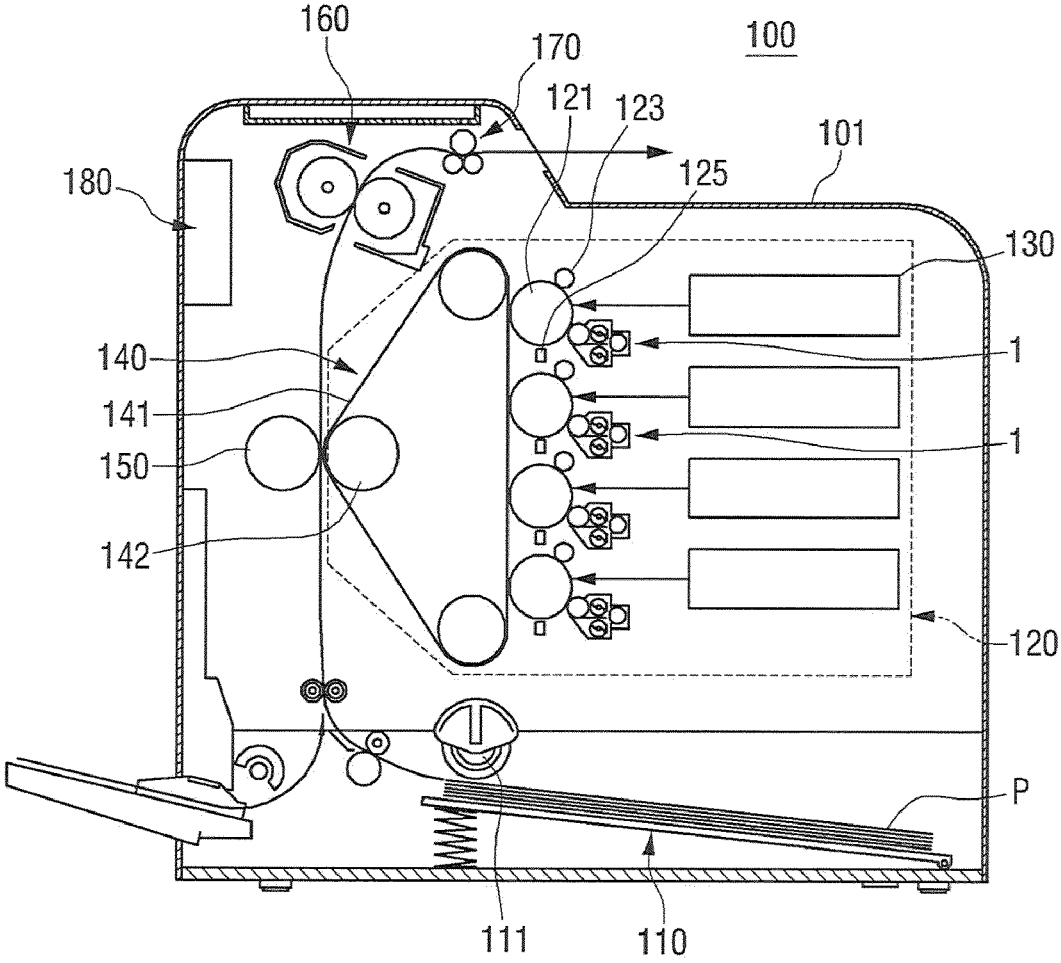
FIG. 7 is a sectional view schematically illustrating an image forming apparatus according to an embodiment of the present disclosure.

As one example of such determining method, after a new developer supplying apparatus 1 is mounted in an image forming apparatus, such as, for example, the image forming apparatus 100 in FIG. 7, the control portion 70 can calculate the total cumulative number of pages and/or the total cumulative number of dots of print data that have been printed by the image forming apparatus 100. The control portion 70 can determine whether the first developer level H1 is below the reference level H based on the cumulative total number of pages or the accumulated dots of print data. That is, when the total number of pages reaches a reference or predetermine number of pages, or when the accumulated number of dots reaches a reference or predetermined number of dots, the control portion 70 can control the rotational speed of one or more of the first developer agitating member 30, the second developer agitating member 40 and the developer conveying member 50, so as to increase the amount of developer conveyed from the second developer chamber 12 to the first developer chamber 11. As a result, the first developer level H1 of the first developer chamber 11 can be raised up to the reference level H. The reference number of pages, the reference number of dots and the rotational speeds to be set by the control portion 70 for the first developer agitating member 30, the second developer agitating member 40 and the developer conveying member 50 can be experimentally determined, for example.

In another determining method, the control portion 70 can use a developer level sensor 62 to determine the first developer level H1 of the first developer chamber 11. The developer level sensor 62 can be disposed in the first developer chamber 11 to detect the first developer level H1. When the first developer level H1 of the first developer chamber 11 is below the reference level H, the control portion 70 can control the rotational speeds of one or more of the first developer agitating member 30, the second developer agitating member 40 and the developer conveying member 50 so that the first developer level H1 of the first developer chamber 11 can be raised up to the reference level H.

In another determining method, the control portion 70 can use the toner concentration sensor 61 disposed in the second developer chamber 12 and an image concentration sensor 125 (see FIG. 7) of the image forming apparatus 100 to determine whether the level associated with the amount of developer in the first developer chamber 11 is below the reference level H. For example, when the image forming apparatus 100 in which the developer supplying apparatus 1 is mounted is performing a printing operation, a normal reading of the toner concentration detected by the toner concentration sensor 61 in the second developer chamber 12 and an abnormal reading of the image concentration detected by the image concentration sensor 125 of the image forming apparatus 100 can cause the control portion 70 to determine that the first developer level H1 of the first developer chamber 11 is below the reference level H. In some embodiments, the image concentration sensor 125 can be disposed to detect the concentration of images formed on an intermediate transfer belt 141, as shown in FIG. 7. In other embodiments, the image concentration sensor 125 can be disposed to detect the concentration of images formed on printing media.

In yet another determining method, the control portion 70 can use the lifetime of the developer supplying apparatus 1 to determine whether the first developer level H1 of the first developer chamber 11 is below the reference level H. That is, after a new developer supplying apparatus 1 is mounted on the image forming apparatus 100, the control portion 70 can determine the remaining portion of the expected lifetime of the developer supplying apparatus 1. When the remaining portion of the expected lifetime is below a predetermined reference value, the control portion 70 can determine that the first developer level H1 of the first developer chamber 11 is below the reference level H. For example, after the use of the developer supplying apparatus 1 has reached or passed about 70% of its expected lifetime, the control portion 70 can determine that the first developer level H1 of the first developer chamber 11 is below the reference level H, and can control the rotation speed of one or more of the first developer agitating member 30, the second developer agitating member 40, and the developer conveying member 50 so that the first developer level H1 of the first developer chamber 11 can be raised up to the reference level H. The relationship between the reference level H and the remaining portion of the expected lifetime of the developer supplying apparatus 1 can be determined from experimental results, for example.

The operation of the developer supplying apparatus 1 according to one or more of the above-described embodiments that can be used with an image forming apparatus is described below with reference to FIGS. 1-5.

Figure 3:
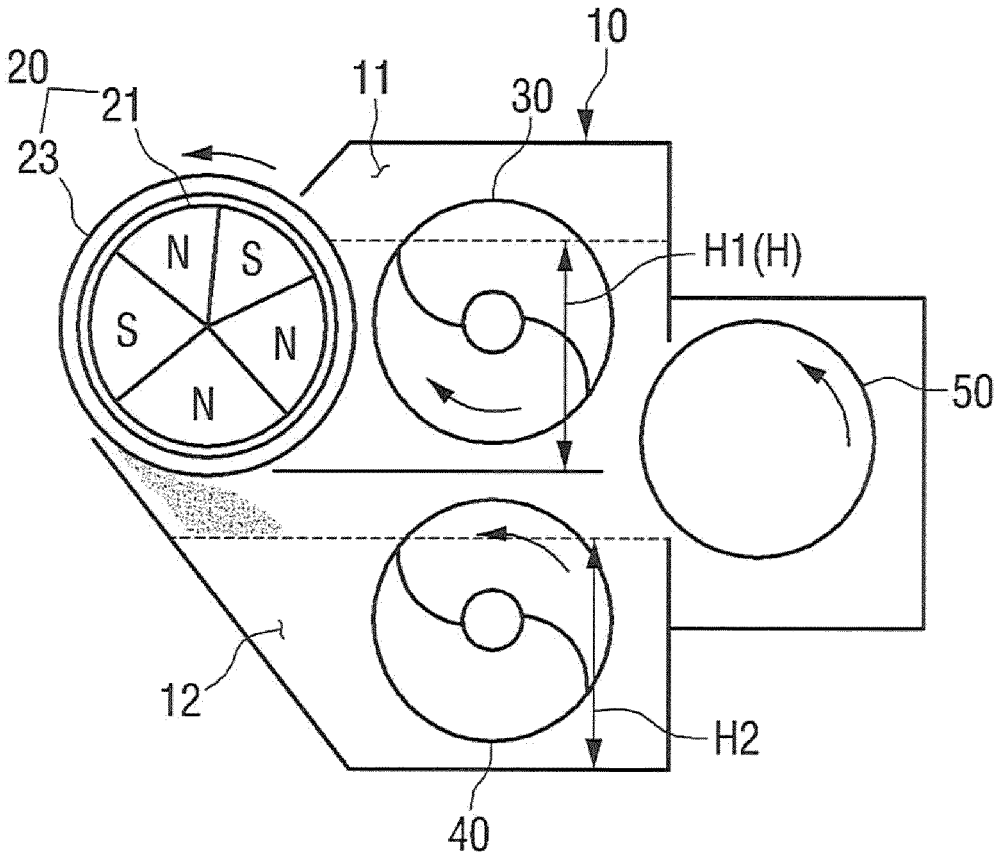
FIG. 3 is a sectional view illustrating the developer supplying apparatus in which the stored amount of developer exceeds a reference level.

When a new developer supplying apparatus 1 is mounted in the image forming apparatus 100 (for example, one shown in FIG. 7) and the image forming apparatus 100 performs a printing operation, as illustrated in FIG. 3, the developer supplying apparatus 1 can supply developer to the photosensitive medium 121 in a state that the first and second developer levels H1 and H2 of the first and second developer chambers 11 and 12 of the developer supplying apparatus 1 are maintained at the reference level H.

Figure 4:
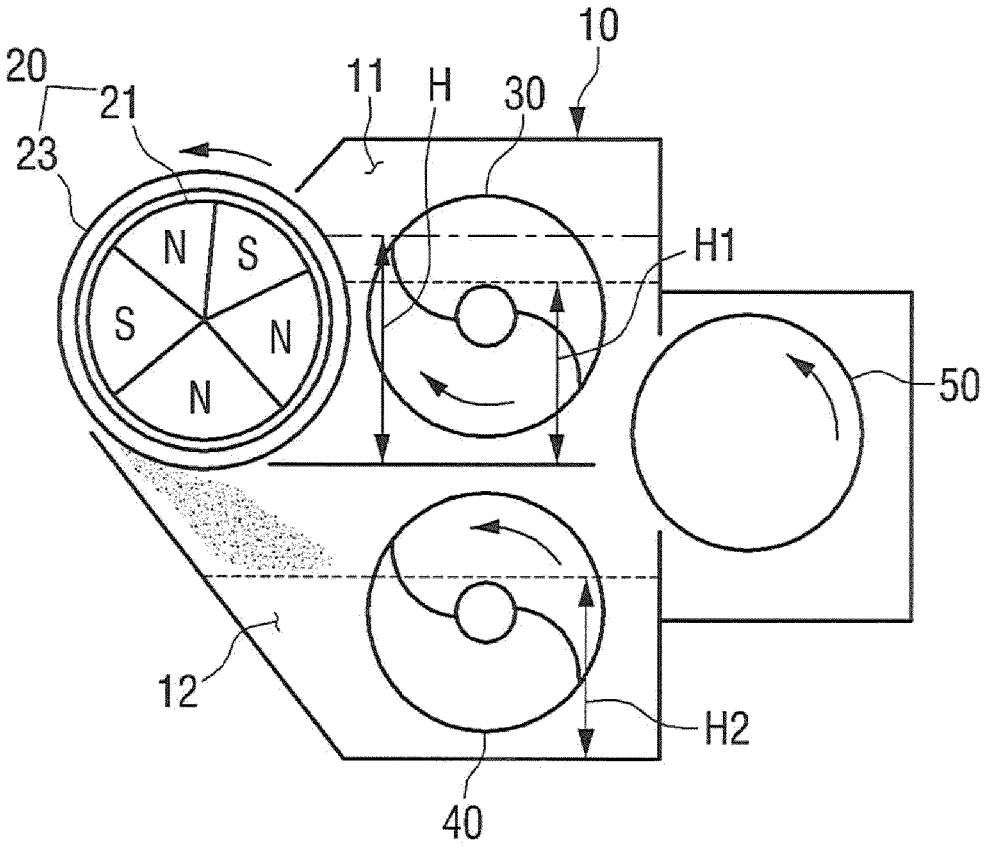
FIG. 4 is a sectional view illustrating the developer supplying apparatus in which the stored amount of developer is below a reference level.
Figure 5:
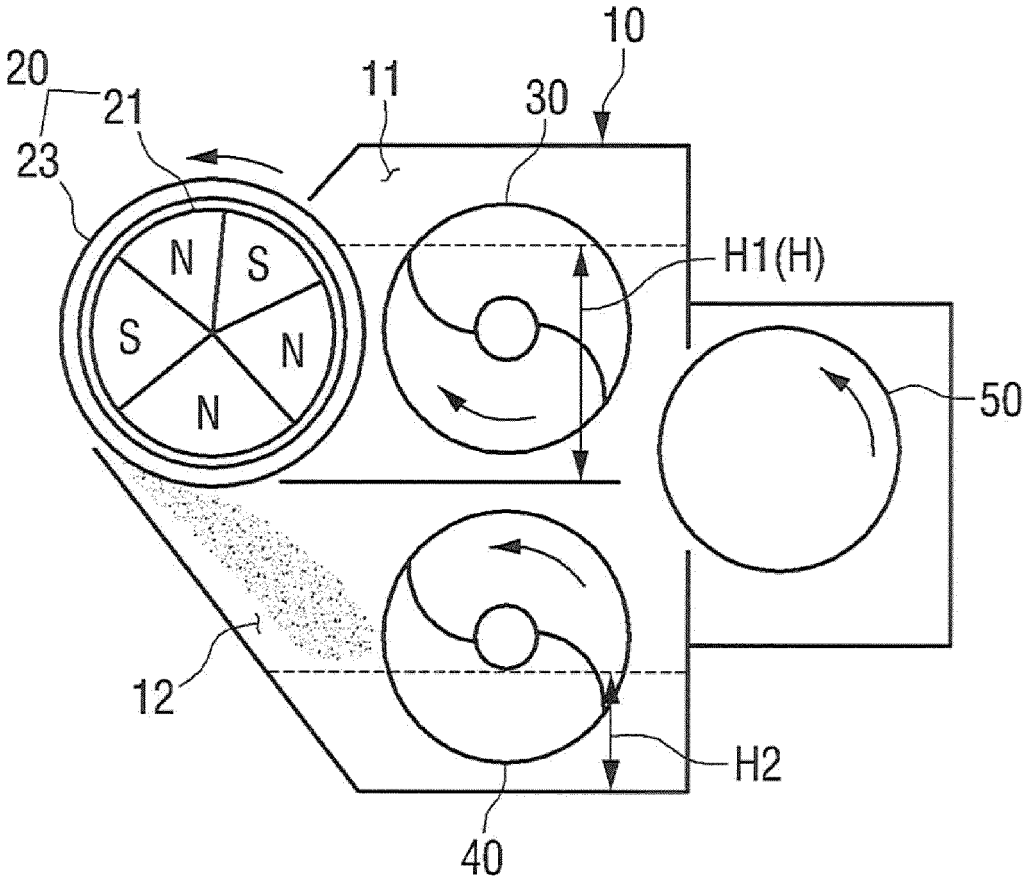
FIG. 5 is a sectional view illustrating the developer supplying apparatus of FIG. 4 of which the first developer level in the first developer chamber is adjusted to a reference level.

As the printing operation continuous to be performed, the toner in the developer can be continuously supplied by the toner supplying apparatus 60 but the carrier in the developer is not supplied so that the amount of carrier in the developer supplying apparatus 1 is slowly reduced by the carrier phenomenon. When a predetermined amount of carrier in the developer is consumed, the first and/or the second developer levels H1 and/or H2 of the first and second developer chambers 11 and 12 can be below the reference level H, as illustrated in FIG. 4.

When the first and/or the second developer levels H1 and/or H2 of the first and second developer chambers 11 and 12 is (are) below the reference level H, the control portion 70 can change the rotational speed of one or more of the first developer agitating member 30, the second developer agitating member 40 and the developer conveying member 50 so that the amount of developer conveyed from the second developer chamber 12 to the first developer chamber 11 can be increased to raise the first developer level H1 of the first developer chamber 11 until the reference level H is reached and maintained. As a result, the second developer level H2 of the second developer chamber 12 can be lower than the first developer level H1 of the first developer chamber 11 (see FIG. 5).

Using the developer supplying apparatus 1 described above can delay the occurrence of image defects such as auger marks, for example. Thus, the developer supplying apparatus 1 can have a longer lifetime than the lifetime of conventional developer supplying apparatuses.

FIG. 6 is a sectional view schematically illustrating a developer supplying apparatus 1' that can be used with an image forming apparatus according to another embodiment of the present disclosure.

Referring to FIG. 6, the developer supplying apparatus 1' can include a housing 10', a magnetic medium 20, the first developer agitating member 30, the second developer agitating member 40, a developer conveying member 50' and a control portion (not shown).

An interior of the housing 10' can be divided into a first developer chamber 11' and a second developer chamber 12', each configured to receive developer. The first developer chamber 11' can be disposed near or directly adjacent to the magnetic medium 20, and the second developer chamber 12' can be substantially horizontally disposed in parallel with the first developer chamber 11'. The first and second developer agitating members 30 and 40 can be disposed in the first and second developer chambers 11' and 12', respectively.

The developer supplying apparatus 1' can differ from the developer supplying apparatus 1 in that the first and second developer chambers 11' and 12' disposed inside the housing 10' are horizontally arranged. Other remaining elements and configurations of the developer supplying apparatus 1' may be substantially the same as those described above in connection with the developer supplying apparatus 1, the detailed descriptions for the same are thus not necessary, and are thus not repeated.

FIG. 7 is a sectional view schematically illustrating the image forming apparatus 100 having a developer supplying apparatus 1 according to an embodiment of the present disclosure.

Referring to FIG. 7, the image forming apparatus 100 can include a main casing 101, a printing media feeding unit 110, an image forming unit 120, a transferring roller 150, a fusing unit 160, a discharging unit 170, and a main control portion 180.

The main casing 101 can be configured to define an outer appearance of the image forming apparatus 100, and can house and support the printing media feeding unit 110, the image forming unit 120, the transferring roller 150, the fusing unit 160 and the discharging unit 170. The main control portion 180 can be disposed inside the main casing 101.

The printing medium feeding unit 110 can be configured to store printing media P therein, and may include a pickup roller 111 disposed at a leading end of the printing medium feeding unit 110 that is configured to pick up the stored printing media P one at a time. The picked-up printing media P is feed to the transferring roller 150.

The image forming unit 120 can be configured to form predetermined images corresponding to print data, and can include multiple exposure units 130, multiple photosensitive media 121, multiple developing apparatuses 1 and an intermediate transfer unit 140. In this embodiment, the image forming unit 120 can include four exposure units 130, four photosensitive media 121, and four developing apparatuses 1 to form full color images.

The exposure unit 130 can be configured to emit light (e.g. a laser beam) corresponding to print data to form electrostatic latent images on the photosensitive medium 121.

The developing apparatus 1 can be configured to store a quantity of developer and to develop the electrostatic latent images formed on the photosensitive medium 121 into visible toner images. The developing apparatus 1 can be, for example, the developer supplying apparatus 1 as described above, and can be configured to use two-component developer to develop the electrostatic latent images into visible toner images. Each of the four developing apparatuses 1 in the embodiment associated with FIG. 7 can supply one of yellow (Y), magenta M, cyan (C), and black (B) developers.

The intermediate transfer unit 140 allows toner images formed on the plurality of photosensitive media 121 to be superimposed to form a full color image, and may include an intermediate transfer belt 141 and a plurality of rollers 142. The intermediate transfer belt 141 may be formed so that the toner images formed on the plurality of photosensitive media 121 are sequentially transferred to the intermediate transfer belt 141 to form the full color image. The plurality of rollers 142 may support the intermediate transfer belt 141 to rotate about an endless loop.

The transferring roller 150 can be configured to cause the full color toner images formed on the intermediate transfer belt 141 to be transferred to the printing media P fed from the printing medium feeding unit 110.

The fusing unit 160 can be configured to allow the toner image transferred to the printing media P to be fused to the printing media P. The discharging unit 170 can be configured to discharge the printing media P having the toner images fused thereon to a space outside of the image forming apparatus 100.

The main control portion 180 can include hardware (e.g., input/output interfaces, circuitry, central processing units, microcontrollers and/or memory) and/or software (e.g., operating system, drivers, programs, applications) that can be configured to control various components of the image forming apparatus 100. For example, the main control portion 180 can control one or more of the printing media feeding unit 110, the image forming unit 120, the transferring roller 150, the fusing unit 160, and the discharging unit 170 to perform a printing operation. The method by which the main control portion 180 controls the above described components to perform one or more of the functions of a printing operation can be similar to that of the conventional image forming apparatus; therefore, detailed descriptions thereof are omitted.

The main control portion 180 can include the functionality described above with respect to the control portion 70 of the developer supplying apparatus 1. That is, the main control portion 180 of the image forming apparatus 100 can be configured to perform some or all of the functions of the control portion 70 of the developer supplying apparatus 1. For example, the main control portion 180 can control the rotational speeds of one or more of the first developer agitating member 30, the second developer agitating member 40 and the developer conveying member 50 of the developer supplying apparatus 1 to adjust the first developer level H1 of the first developer chamber 11. That is, when the first developer level H1 of the first developer chamber 11 is below the reference level H, the main control portion 180 can perform control operations that cause an increase in the rotation speeds of the second developer agitating member 40 or/and the developer conveying member 50 so that the amount of the developer conveyed from the second developer chamber 12 to the first developer chamber 11 can be increased to raise up the first developer level H1 of the first developer chamber 11 until the first developer level H1 reaches the reference level H.

The operations of the image forming apparatus 100 according to an embodiment of the present disclosure are described below with reference to FIGS. 1 and 7.

When a print command or instruction and print data are received from a host (not shown), the main control portion 180 can control the printing medium feeding unit 110 to pick up a printing medium P and to feed the picked-up printing medium P between the image forming unit 120 and the transferring roller 150.

Concurrently with the above-described operation, a charging member 123 can charge the photosensitive medium 121 to a predetermined voltage, and the exposure unit 130 can emit light to form electrostatic latent images corresponding to the print data on the charged surface of the photosensitive medium 121.

The developing apparatus 1 can supply developer, namely, toner, to develop the electrostatic latent images formed on the photosensitive medium 121 into visible toner images.

The toner images formed on the four photosensitive media 121 can be transferred in an overlapped manner to the intermediate transfer belt 141 to form a full color image. The transferring roller 150 can allow the full color image formed on the intermediate transfer belt 141 to be transferred to the printing medium P that passes between the intermediate transfer belt 141 and the transferring roller 150.

As the printing medium P advances further to pass through the fusing unit 160, the toner images transferred to the printing medium P can be fixed to the printing medium P by heat and pressure of the fusing unit 160. The discharging unit 170 can discharge the printing medium P having the toner images fixed thereon out of the main casing 101.

While the main control portion 180 controls one or more of the printing media feeding unit 110, the image forming unit 120, the transferring roller 150, the fusing unit 160, and the discharging unit 170 and continues to perform a printing operation, the control portion 70 or the main control portion 180 can monitor whether the first developer level H1 has been lowered below the reference level H. As describe above with respect to the several method to determine whether the first developer level H1 is below the reference level H, the control portion 70 can use one or more of the total number of printed pages, the accumulated number of dots of print data, the developer level sensor 62, the toner concentration sensor 61, the image concentration sensor 125, and the remaining lifetime expectancy of the developer supplying apparatus 1, for example, to make such determination.

When the first developer level H1 is below the reference level H, the control portion 70 or the main control portion 180 can control the rotational speeds of one or more of the first developer agitating member 30, the second developer agitating member 40 and the developer conveying member 50 so that the first developer level H1 of the first developer chamber 11 can be raised up to the reference level H. By controlling the first developer level H1 of the first developer chamber 11, the image forming apparatus 100 can perform a printing operation without generating image defects such as an auger mark.

Also, an image forming apparatus 100 having a developer supplying apparatus 1 can print high concentration images. To produce high concentration images, the first developer level H1 of the first developer chamber 11 of the developer supplying apparatus 1 can be raised up over the reference level H. That is, when the control portion 70 or the main control portion 180 increases the rotational speed, namely, the number of rotation per unit time of the developer conveying member 50, the amount of developer conveyed from the second developer chamber 12 to the first developer chamber 11 can be increased. As a result, the first developer level H1 of the first developer chamber 11 can be raised to a level at which the density of the developer on the magnetic medium 20 is increased and high concentration images can be formed on the photosensitive medium 121.

The image concentration sensor 125 disposed above the intermediate transfer belt 141 can be used to check whether the images have the desired high concentration. When the concentration of the image is higher than the desired concentration, the control portion 70 or the main control portion 180 can decrease the rotational speed of the developer conveying member 50. When the rotational speed of the developer conveying member 50 is decreased, the amount of developer conveyed from the second developer chamber 12 to the first developer chamber 11 can be reduced so that the density of developer on the magnetic medium 20 is decreased. When the density of developer on the magnetic medium 20 is decreased, the concentration of the images formed on the photosensitive medium 121 can be reduced.

While several embodiments of the present disclosure have been described, additional variations and modifications of the embodiments may occur to those skilled in the art. The appended claims include both the above embodiments and all such variations and modifications that fall within the spirit and scope of the disclosure.

What is claimed is:

1. A developing apparatus, comprising:

a housing defining a first chamber and a second chamber, a magnetic member rotatably disposed near the first chamber of the housing, the magnetic medium including a magnetic material;

a first agitating member disposed in the first chamber of the housing, the first agitating member being configured to agitate the developer in the first chamber and to move the developer in the first chamber in a first direction;

a second agitating member disposed in the second chamber of the housing, the second agitating member configured to agitate the developer in the second chamber and to move developer in the second chamber in a second direction different from the first direction; and a controller configured to control a first developer level associated with an amount of developer in the first chamber in order to maintain the first developer level at a predetermined level in the first chamber by adjusting a rotational speed of the first agitating member or the second agitating member.

2. The developing apparatus of claim 1, further comprising:

a conveyor disposed between the first chamber and the second chamber of the housing, the conveyer being configured to move developer from the second chamber to the first chamber, wherein the controller is configured to control the conveyor to adjust the first developer level in the first chamber and the second developer level in the second chamber.

3. The developing apparatus of claim 2, wherein the conveyor is configured to produce a magnetic force to move developer from the second chamber to the first chamber.

4. The developing apparatus of claim 2, wherein the conveyor includes one of an auger and a paddle.

5. The developing apparatus of claim 2, wherein the controller is configured to adjust a rotational speed associated with the conveyor to control an amount of developer moved by the conveyor from the second chamber to the first chamber.

6. The developing apparatus of claim 1, further comprising:

a sensor disposed in the first chamber and configured to detect the amount of developer in the first chamber, wherein the controller is configured to use information provided by the sensor to determine whether the first developer level is lower than the predetermined level.

7. The developing apparatus of claim 1, further comprising:

a sensor disposed in the second chamber and configured to detect a developer concentration;

wherein the controller is configured to use information provided by the sensor to determine whether the first developer level is lower than the predetermined level.

8. The developing apparatus of claim 7, wherein the controller is configured to determine whether the first developer level is lower than the predetermined level based on a developer concentration of an image formed by an image forming apparatus.

9. The developing apparatus of claim 1, wherein the controller is configured to determine whether the first level is lower than the predetermined level based on a remaining useful life of the developer supplying apparatus.

10. The developing apparatus of claim 1, wherein the first chamber and the second chamber are vertically arranged.

11. The developing apparatus of claim 10, wherein the second chamber is configured to receive developer from the magnetic member.

12. The developing apparatus of claim 1, wherein the first chamber and the second chamber are horizontally arranged.

13. An image forming apparatus, comprising:

a photosensitive medium;

a developing apparatus configured to supply developer to the photosensitive medium to form toner images, the developing apparatus including a housing that defines a first and a second chamber, a magnetic member that includes magnetic material rotatably disposed near the first chamber of the housing, a first agitating member disposed in the first chamber of the housing and a second agitating member disposed in the second chamber of the housing, the first agitating member configured to agitate developer in the first chamber and to move developer in the first chamber in a first direction, the second agitating member configured to agitate developer in the second chamber and to move developer in the second chamber in a second direction different from the first direction;

a transfer roller configured to transfer the toner images formed on the photosensitive medium to a printing medium; and a controller configured to control a first developer level associated with an amount of developer in the first chamber in order to maintain the first developer level at a predetermined level in the first chamber by adjusting a rotational speed of the first agitating member or the second agitating member.

14. A developing apparatus for supplying developer of a two-component type containing a mixture of toner and carrier, comprising:

a first chamber and a second chamber each defining a volume in which to receive the developer, the first and second chambers being in fluid communication so as to allow an amount of the developer to move from the second chamber to the first chamber;

a magnetic member including a magnetic material disposed near the first chamber to receive toner particles of the developer from the first chamber, the second chamber being configured to receive carrier particles of the developer from the magnetic member, and to receive supplemental supply of the developer;

a first agitator disposed in the first chamber and configured to move developer received in the first chamber;

a second agitator disposed in the second chamber configured to move developer received in the second chamber; and a controller configured to adjust the amount of the developer moving from the second chamber to the first chamber based on a level of developer received in the first chamber in order to maintain the first developer level at a predetermined level in the first chamber by adjusting a rotational speed of the first agitating member or the second agitating member.

15. The developing apparatus of claim 14, further comprising:

a developer conveying device disposed between the first and second chambers and configured to transfer the developer from the second chamber to the first chamber;

wherein the controller is further configured to control the developer conveying device so as to adjust the amount of developer moving from the second chamber to the first chamber.

16. The developing apparatus of claim 14, further comprising:

a developer level sensor configured to detect the level of developer received in the first chamber, wherein the controller is configured to determine whether the level of developer received in the first chamber is less than a threshold level based on a detection signal received from the developer level sensor, and, if the level of developer received in the first chamber is determined to be less than the threshold level, to increase the amount of the developer moving from the second chamber to the first chamber.

17. The developing apparatus of claim 14, wherein the controller is configured to determine whether the level of developer received in the first chamber is less than a threshold level based on remaining useful life of the developer supplying apparatus, and, if the level of developer received in the first chamber is determined to be less than the threshold level, to increase the amount of the developer moving from the second chamber to the first chamber.

18. The developing apparatus of claim 14, wherein the controller is configured to determine whether the level of developer received in the first chamber is less than a threshold level based on cumulative number of toner images formed using the developer supplying apparatus, and, if the level of developer received in the first chamber is determined to be less than the threshold level, to increase the amount of the developer moving from the second chamber to the first chamber.

19. The developing apparatus of claim 14, wherein each of the first and second agitators comprises an auger, the first agitator being configured to move the developer received in the first chamber in a first direction, the second agitator being configured to move the developer received in the second chamber in a second direction opposite the first direction.

* * * * *

UNITED STATES PATENT AND TRADEMARK OFFICE

CERTIFICATE OF CORRECTION

PATENT NO. : 8,233,814 B2
APPLICATION NO. : 12/542337
DATED : July 31, 2012
INVENTOR(S) : So-Won Sheen It is certified that error appears in the above-identified patent and that said Letters Patent is hereby corrected as shown below:

In the Claims:

Column 14, Line 47, In Claim 1, after "agitate" delete "the".

Signed and Sealed this
Fourteenth Day of May, 2013

Teresa Stanek Rea
*Acting Director of the United States Patent and Trademark Office*